United States Patent [19]

Horne

[11] Patent Number: 4,515,334

[45] Date of Patent: May 7, 1985

[54] CONTAINER RACK

[76] Inventor: Edward A. Horne, 3059 Oak Leaf Ct., Woodbridge, Va. 22192

[21] Appl. No.: 374,777

[22] Filed: May 4, 1982

[51] Int. Cl.[3] ..... A47B 73/00

[52] U.S. Cl. ..... 248/146; 248/346; 248/DIG. 12; 211/74

[58] Field of Search ..... 248/DIG. 12, 146, 148, 248/105, 154, 346, 117.2–117.6, 514, 133; 141/106, 364, 375; 222/173; 215/100 R; D7/70, 71; 211/74

[56] References Cited

U.S. PATENT DOCUMENTS

| | | | |
|---|---|---|---|
| D. 45,362 | 3/1914 | Woodside | 248/105 |
| 611,857 | 10/1898 | Buck | 248/105 |
| 1,017,756 | 2/1912 | Head | 215/100 R |
| 1,633,083 | 6/1927 | Fite | 248/105 |
| 2,527,796 | 10/1950 | Clute | 211/74 |
| 3,964,709 | 6/1976 | LaBelle | 211/74 |

FOREIGN PATENT DOCUMENTS

| | | | |
|---|---|---|---|
| 217411 | 3/1961 | Austria | 211/74 |
| 2470158 | 6/1981 | France | 211/74 |
| 16940 | of 1902 | United Kingdom | 248/133 |

*Primary Examiner*—William H. Schultz
*Assistant Examiner*—Robert A. Olson
*Attorney, Agent, or Firm*—Berman, Aisenberg & Platt

[57] ABSTRACT

A rack for a container, such as a wine bottle, comprises a base and a support. The support receives the neck of the bottle in either an elevated, or a lowered position. The base provides a depression to receive the shoulder of a container in the lowered position, and a notch to receive the bottom of the container in the elevated position.

5 Claims, 3 Drawing Figures

CONTAINER RACK

TECHNICAL FIELD

The invention relates to a rack for storing a container having a liquid therein.

BACKGROUND ART

Racks for supporting bottles, particularly wine bottles, are known in the art. These racks ordinarily take the form of supports which cradle the bottle at two locations along the bottle. One of these locations is near the shoulder of the bottle and the other is near the bottom of the bottle. The racks support the bottle in a position so that the neck is lowered and the contents of the bottle are in contact with the cork which seals the bottle. This is to insure that the cork remains moist, because a dried-out cork is difficult to remove and may crack during removal.

After a wine bottle has been opened it should be stored in a refrigerator, and if the bottle is resealed with a cork, the bottle should be stored in such a position that the cork is kept moist. On the other hand, if the bottle is not resealed with a cork, such as in the case of a bottle having a threaded cap, the opening should be elevated so that the wine does not come into contact with the cap, and leak due to a poor seal.

The racks of the prior art are used to store a plurality of bottles and are not adapted to be placed on the shelf of a refrigerator. If an open wine bottle is simply laid on a shelf, the cork will be kept moist only if a large amount of wine remains in the bottle, and the bottle will roll and be an inconvenience. Storing a bottle with a threaded cap, upright is many times impossible in the usual refrigerator, since the selves are too close together.

STATEMENT OF THE INVENTION

The invention comprises a rack for holding a bottle, particularly a wine bottle, in such a manner that the opening may be either elevated or lowered, and so that it easily fits on a refrigerator shelf. The rack of the invention includes a rectangular base portion having an upstanding support at one end of the base. The support is shaped to receive the neck of a bottle either on an upper end of the support, or a lower end. When the neck is supported on the upper end, the open end of the bottle is in an elevated position. On the other hand, when the neck of the bottle is placed at the lower end of the support the opening will be retained in a lowered position. The base includes a notch at its end opposite the end having the support, for receiving the bottom of the bottle when the opening is resting on the upper portion of the support.

It is an object of this invention to provide a rack for a bottle so that the bottle may be supported in one of two different positions.

It is another object of this invention to provide a rack for a bottle which is convenient, portable, and which may be used to store a bottle in a generally horizontal position.

It is another object of the invention to provide a rack for a bottle which prevents the bottle from rolling.

DETAILED DESCRIPTION OF THE DRAWINGS

Figure 1:
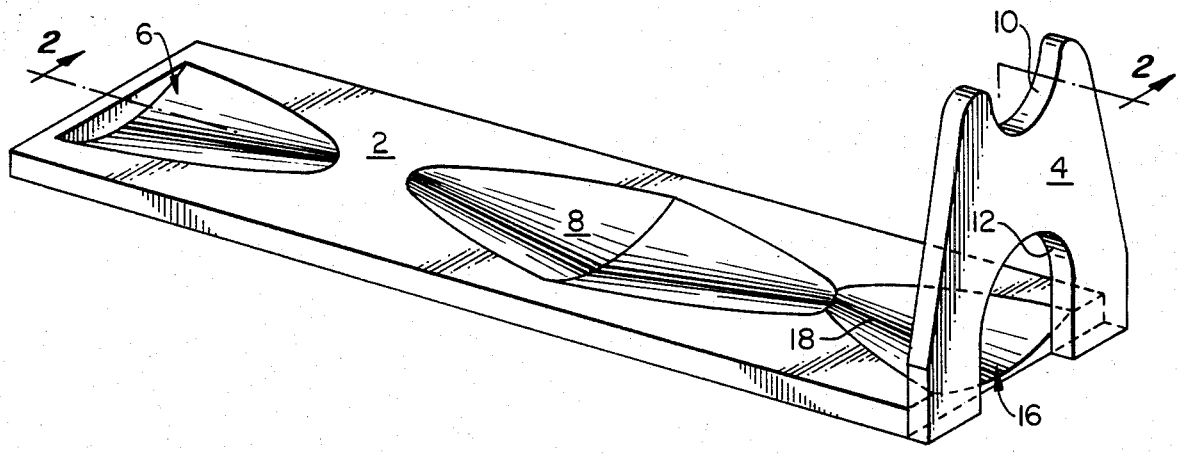
FIG. 1 is a perspective view of the rack of the invention.

The bottle rack of the invention generally comprises a base portion 2 and a support portion 4. As shown in FIG. 1 the base 2 is rectangular, but it may be other shapes. The base portion 2 includes a notch 6 in the end opposite the end having the support 4. The notch 6 is arcuate in a transverse cross-section and is adapted to receive a portion of the bottom of a bottle being stored. The base includes a concave depression 8 which receives the shoulder of a bottle being stored when the bottle is in the position shown in FIG. 2.

The concave depression 8 and the notch 6, are arcuate in a plane transverse to the long dimension of the base, and V-shaped in longitudinal cross-section.

The support 4 includes a semicircular cut-out 10 at one end thereof, and a U-shaped cut-out 12 at the other end thereof. The semicircular cut-out 10 serves to support the neck of a bottle when it is desired to store the bottle with its opening elevated. The U-shaped cut-out 12 serves to receive the neck of the bottle when it is desired to store the opening of the bottle in a lowered position.

Figure 2:
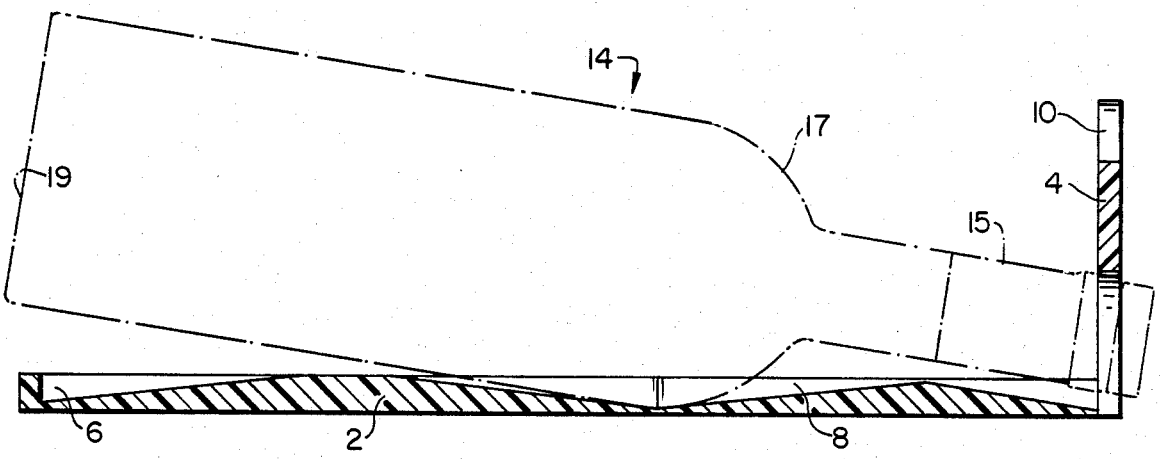
FIG. 2 is a cross section of the rack of the invention taken along line 2—2 of FIG. 1, and showing the bottle having its opening in a lowered position.
Figure 3:
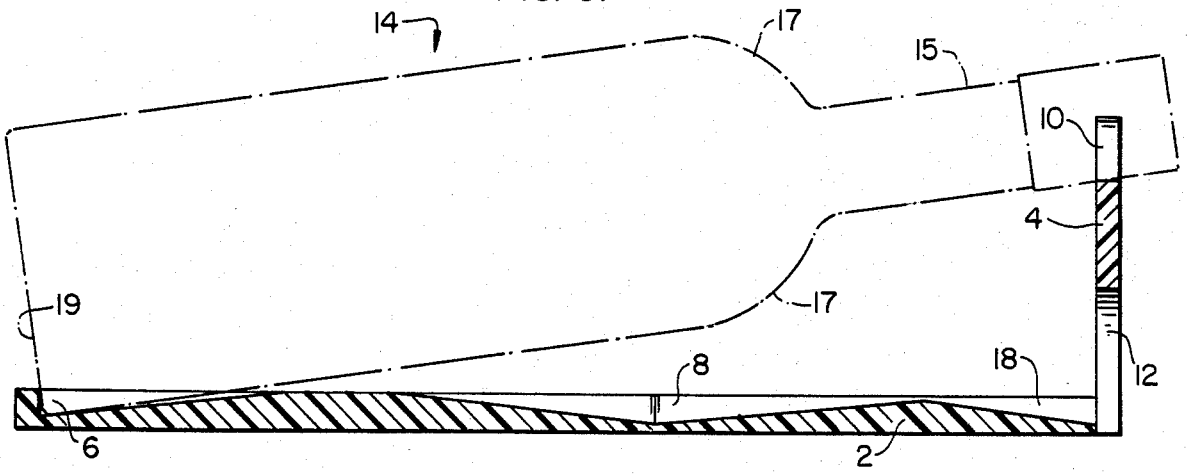
FIG. 3 is a cross section of the rack of the invention taken along line 2—2 of FIG. 1, and showing a bottle being supported by the rack with its opening in an elevated position.

The use of the two portions of the support is illustrated in FIGS. 2 and 3, where a bottle 14 is shown in broken lines. As seen in FIG. 2 the neck 15 of the bottle is received in a hole 16 formed by the U-shaped cut-out 12 and the base 2. The shoulder 17 of the bottle is received in the concave depression 8 and the bottle is thus retained in a position so that the cork is kept moist by the liquid in the bottle. The base 2 extends at least to the horizontal location of the center of gravity of the bottle and the liquid contained therein.

The concave depression 8 serves two purposes. First, it cooperates with the hole 16 to provide support for the bottle in a vertical plane. Because of its V-shape in one direction it can accommodate a variety of sizes of bottles. Second, its arcuate shape in a transverse plane allows it to act as a cradle to prevent the bottle from rolling in a horizontal plane. It may be seen, therefore, that the depression 8 and the hole 16 provide a secure rack for storing a bottle 14 with its opening in a lowered position.

The semicircular cut-out 10 and notch 6 cooperate, as shown in FIG. 3, to support the bottle 14 with its opening in an elevated position. The notch 6 receives bottom 19 to prevent the bottle from sliding out of the cut-out 10 and also cradles the bottle in a manner similar to that described with respect to the concave depression 8, to prevent the bottle from rolling in a horizontal plane.

The base 2 also includes a cavity 18 which is shaped similarly to concave depression 8, and enlarges the hole 16 to facilitate entry of the neck of the bottle.

It may be seen that a rack for a bottle has been described which allows for a bottle to be conveniently stored in either of two positions.

What is claimed is:

1. A rack for a container having a neck, shoulder, and bottom comprising:

a base comprising shoulder receiving means for receiving said shoulder and bottom receiving means for receiving said bottom, said shoulder receiving means and said bottom receiving means being substantially coplanar, and support means at one end of said base extending transversely to said base for receiving the neck of said container in either an upper or a lower end of said support means, said shoulder receiving means being intermediate said support means and said bottom receiving means, said upper end of said support means comprises means for receiving said neck when said bottom is received by said bottom receiving means, and said lower end of said support means comprises means for receiving said neck when said shoulder is received by said shoulder means, whereby said neck is elevated when received in said upper end and depressed when received in said lower end.

2. The rack of claim 1 wherein said shoulder receiving means includes a concave depression for receiving said shoulder of said container when said neck is supported by said lower end of said support means.

3. The rack of claim 2 wherein said bottom receiving means includes a notch for receiving a portion of the bottom of said container, when said neck is supported by said upper end of said support means.

4. The rack of claim 3 wherein said support means has a generally semicircular cut-out at said upper end, and a generally U-shaped cut-out at said lower end, and wherein said lower end is attached to said one end of said base.

5. The rack of claim 3 or 4 wherein said concave depression is arcuate in transverse cross-section, and V-shaped in longitudinal cross-section.

* * * * *